US005575667A

United States Patent [19]

Mehez et al.

[11] Patent Number: 5,575,667

[45] Date of Patent: Nov. 19, 1996

[54] JUNCTION BOX FOR CONNECTING A PLURALITY OF SCREENED CABLES

[75] Inventors: Michel Mehez, Sucy en Brie; Bernard Warusfel, Vanves, both of France

[73] Assignee: Cegelec, Levollois Perret, France

[21] Appl. No.: 391,035

[22] Filed: Feb. 21, 1995

[30] Foreign Application Priority Data

Feb. 18, 1994 [FR] France ..... 94 01 880

[51] Int. Cl.[6] ..... H01R 4/66

[52] U.S. Cl. ..... 439/98; 439/579

[58] Field of Search ..... 439/98, 610, 579; 174/51, 59

[56] References Cited

U.S. PATENT DOCUMENTS

| | | | |
|---|---|---|---|
| 3,848,224 | 11/1974 | Olivero | 174/59 X |
| 4,790,775 | 12/1988 | David | 439/579 OR |
| 5,044,978 | 9/1991 | Gelin | 439/579 X |
| 5,123,853 | 6/1992 | Gilbert et al. | 439/98 OR |

FOREIGN PATENT DOCUMENTS

| | | |
|---|---|---|
| 0400521A1 | 12/1990 | European Pat. Off. . |
| 2666695A1 | 3/1992 | France . |
| 3418582A1 | 12/1984 | Germany . |

OTHER PUBLICATIONS

French Search Report FR 9401880.

*Primary Examiner*—Khiem Nguyen
*Assistant Examiner*—Daniel Wittels
*Attorney, Agent, or Firm*—Sughrue, Mion, Zinn, Macpeak & Seas

[57] ABSTRACT

To interconnect the screens (4, 29) of all the screened cables the box includes:

a conductive enclosure (15, 19) forming a Faraday cage;

a metal plate (5) with holes (7) for fixing each cable (1, 22, 18) using a self-locking tie (6, 20);

and lugs (25) cut out from the plate and bent out of the plane of the plate to constitute crimping or soldering connection points for interconnecting the screens of the cables and connecting them to ground, either via a filter (11) connected to the conductive enclosure (15, 18) for high-frequency currents, or directly by a grounding wire.

Applications include industrial computer networks.

4 Claims, 2 Drawing Sheets

JUNCTION BOX FOR CONNECTING A PLURALITY OF SCREENED CABLES

BACKGROUND OF THE INVENTION

1. Field of the Invention

The invention concerns a junction box for connecting a plurality of screened cables, for example screened cables for connecting industrial plants for sending or receiving data. A screened cable of this kind usually includes a plurality of insulated conductors surrounded by an electromagnetic screen in the form of a conductive braid. A junction box is used to connect a branch cable to a main cable for each item of plant to be connected to the main cable, for example.

2. Description of the Related Art

To protect the data transmitted, the screens of all the screened cables connected by a junction box must be connected together. The junction box must also incorporate a conductive enclosure forming a Faraday cage around the devices connecting the conductors transmitting the data. In the case of the FIP field bus and the WORLDFIP field bus, for example, the standards NF C46 604 and IEC 1158-2 set out physical interconnection rules firstly to preserve the matching of the data transmission lines and secondly to interconnect the cable screens correctly and to ground them.

French patent applications Nos 2 666 692 and 2 666 695 describe junction boxes conforming to these standards which enable connection of a branch cable to a main cable without interrupting data traffic on the main cable, even though it is necessary to cut the conductors of the pair of the main cable to divert the data traffic to the plant by means of a first pair and then to return data traffic to the main cable by means of a second pair. These prior art junction boxes include:

- a cutter device for cutting the main cable pair;
- insulation displacement contacts for connecting a first section of the main cable pair to a first branch cable pair;
- insulation displacement contacts for connecting a second section of the main cable pair to a second branch cable pair;
- insulation displacement contacts for connecting a drain wire running along the screen of the main cable to a Faraday cage comprising a metal box or a metalized insulative box around all the connection devices; and
- three cable glands for fixing the two sections of the main cable and the branch cable to the junction box and for connecting to the Faraday cage the screens of the two sections of the main cable and the screen of the branch cable.

A junction box of this kind has the advantage of enabling additional plant to be connected into an existing network without interrupting data traffic for any significant time. However, this type of junction box has the following drawbacks: high cost, large size and the necessity to use special tools for operating the cutter device and the insulation displacement contacts. In some applications, where it is of no consequence if the data traffic has to be interrupted to connect additional plant, or in applications in which it is virtually certain that there will not be any need to connect additional plants in the future these junction boxes are unnecessarily costly.

SUMMARY OF THE INVENTION

An object of the invention is to propose a junction box of much lower cost, of smaller size and which can be installed without using special tools. This junction box must naturally meet the physical interconnection rules set out in the standards mentioned above. In particular, it must provide a reliable connection between the screens of two sections of a main cable and a branch cable and possible connection thereof to ground.

The junction box must also protect the connections against electromagnetic interference by forming a Faraday cage and protect personnel from contact with the connections and the screens of the cables.

The invention consists in a Junction box for a plurality of screened cables each having an electromagnetic screen, the box including means for fixing the cables and means for interconnecting screens of all the cables and a conductive enclosure forming a Faraday cage and including an opening for each cable.

The junction box is characterized in that the means for fixing all the cables and the means for interconnecting screens of all the cables include:

- a metal plate insulated from the conductive enclosure forming the Faraday cage and incorporating:
  - two holes for each cable, the distance between said holes being similar to the diameter of said cable; and
  - a lug for each cable, cut out from said plate and bent out of the plane of said plate to constitute a connection point for the screen of said cable; and
- a self-locking tie for each cable passing successively through the two holes corresponding to said cable, fitting around said cable and pressing it against the plate to attach it to the plate.

This junction box is of low cost because it does not include any cable glands for fixing cables and interconnecting their screens. Instead, this junction box uses for these functions a metal plate incorporating a small number of easily machined cut-outs and self-locking ties which can be conventional very low cost polyamide ties as used to fix cables to cable supports.

In a preferred embodiment of the invention each lug has a curved end forming a hook adapted to be crimped or soldered to conductors extracted from the screen of a cable and twisted together. It is therefore easy to interconnect the screens of the cables using ordinary pliers or a soldering iron. The insulated conductors of the cables can be interconnected by any low-cost means that require only conventional tools, such as screw terminals or small insulation displacement contacts.

Eliminating the cable glands leads to a substantial reduction in the overall size of the junction box. Its size is further reduced by the elimination of the cutter device, which is not needed in applications where it is not necessary to minimize the interruption of data traffic.

BRIEF DESCRIPTION OF THE DRAWINGS

The invention will be better understood and other details of the invention will emerge from the following description of one embodiment of the invention and the accompanying drawings.

DESCRIPTION OF THE PREFERRED EMBODIMENTS

Figure 1:
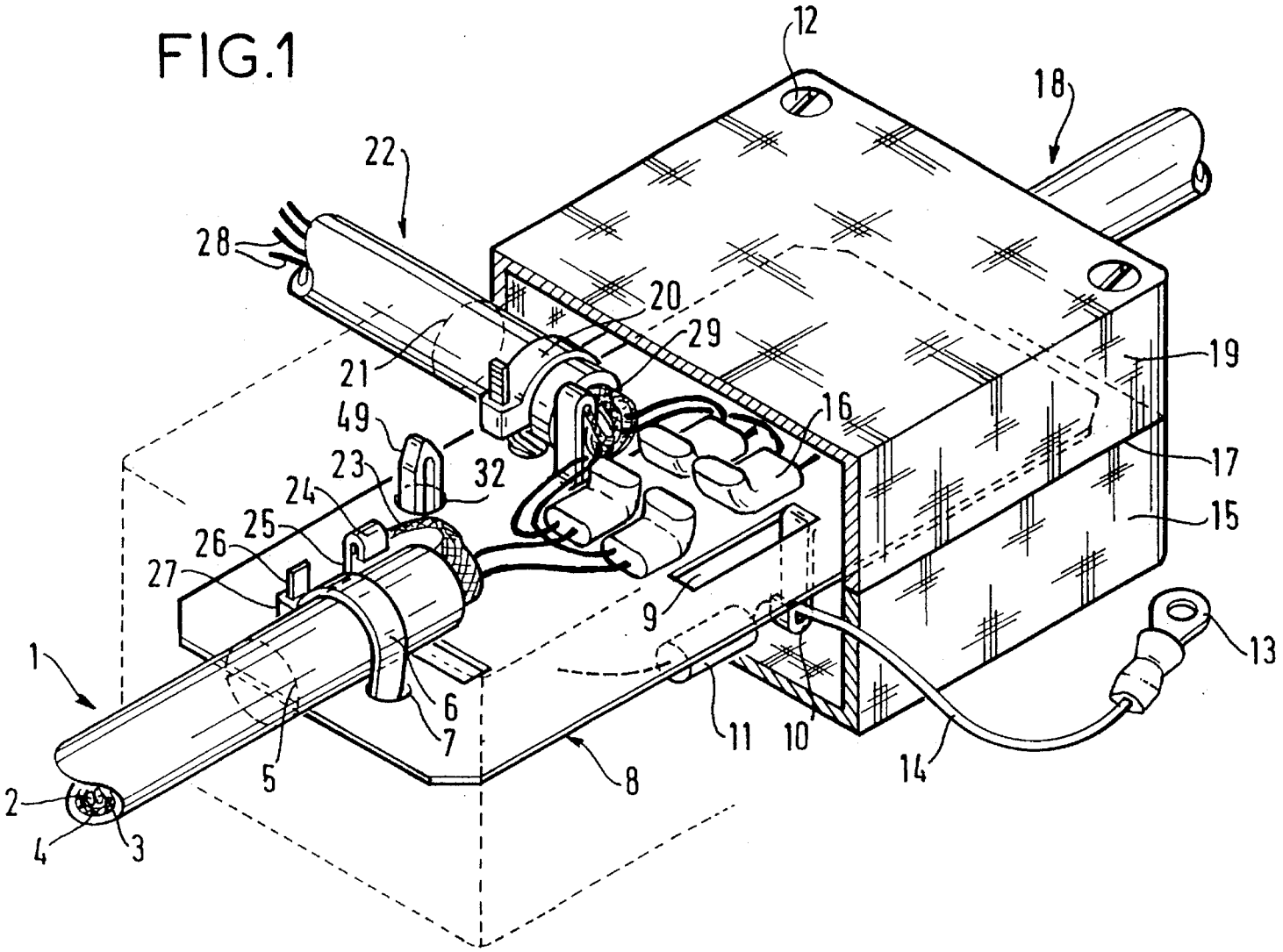
FIG. 1 is a general view of one embodiment of the junction box in accordance with the invention, part of the box being removed to show the interior.

The embodiment of the invention shown in FIG. 1 includes:

- a first section 1 of a main cable;
- a second section 18 of this main cable;
- a branch cable 22;
- a metal plate 8 the main functions of which are fixing the cables 1, 18, 22 and interconnecting their screens;
- three self-locking ties of which only two ties 6 and 20 can be seen in FIG. 1;
- four insulation displacement connection devices 16 each interconnecting two insulated conductors;
- a parallel piped shape metal box comprising two parts 15 and 19 mating along a line 17 passing through three cable openings for cables 1, 18, 22; only two openings 5 and 21 can be seen in FIG. 1; the box constitutes a Faraday cage;
- a filter 11, comprising for example a capacitor and a varistor connected in parallel, connecting the plate 8 to the box 15, 19 for high-frequency currents; and
- a ground connection 14 with a tag 13 at its end for optionally short-circuiting the filter 11 to connect the plate 8 directly to the conductive box 15, 19.

The box 15, 19 is assembled by four screws 12. It is fixed to any kind of support by means that are not shown, such as screws, for example. It is normally connected to a local ground terminal by the means fixing it to the support.

The cables are fixed to and interconnected on the plate 8 outside the box 15, 19. Thus the box does not impede these operations in any way. A notch (not shown) enables the connection 14 to be brought out through the wall of the lower part 15 of the box.

Each main cable section 1 and 18 includes one or more pairs of insulated conductors 2 and 3. These pairs are screened by a screen 4 made up of braided fine metal conductors. The branch cable 22 usually includes at least two pairs of insulated conductors 28 screened by a screen 29 made up of braided fine metal conductors. Two conductors of a first pair of the branch cable 22 are connected to a pair 2, 3 of the first main cable section 1 by two connection devices 16. A second pair of the branch cable 22 is connected to a pair of the second main cable section 18 by two other connection devices 16. In the case of cables including pairs which are not used, the unused pairs are short-circuited at each end. The four connecting devices 16 can be of various known kinds, of low cost and not requiring any special tools. In this example they are insulation displacement jaws.

A few conductors of the braid constituting the screen 4 are pulled out from the braid and twisted together to connect the screen to the metal plate 8. The plate 8 includes a lug 25 whose end is bent to form a hook 24 into which the end of the twisted braid conductors 23 is crimped or soldered. The screen 29 of the branch cable 22 is connected to the metal plate 8 in a similar manner. The screen of the second main cable section 18 is not shown in FIG. 1 but is connected to the metal plate 8 in a similar manner.

The first main cable section 1 is fastened to the metal plate 8 and therefore to the junction box by at least one self-locking tie 6. This tie surrounds the section 1 in an area where the screen 4 has not been bared and is passed through two holes in the plate 8. Only one hole 7 can be seen in FIG. 1. The self-locking tie 6 is a conventional polyamide tie having a passage 27 with a ratchet enabling the end 26 of the tie to be pulled through but preventing it moving in the opposite direction. The tie is tightened by pulling on the end 26 using pliers. It presses the main cable section 1 against the plate 8 to attach it to the plate.

The second main cable section 18 is fixed in a similar way to the plate 8 by a tie that cannot be seen in the figure. The branch cable 22 is fixed to the plate 8 in an analogous manner, using a tie 20.

The metal plate 8 has another lug 10, similar to the lug 25, for crimping or soldering the second end of the ground connection 14 and a connection to the filter 11. The lugs like the lug 25 for connecting the cable screens to the plate 8 are on one side of the plate. The lug 10 is on the other side of the plate.

Figure 2:
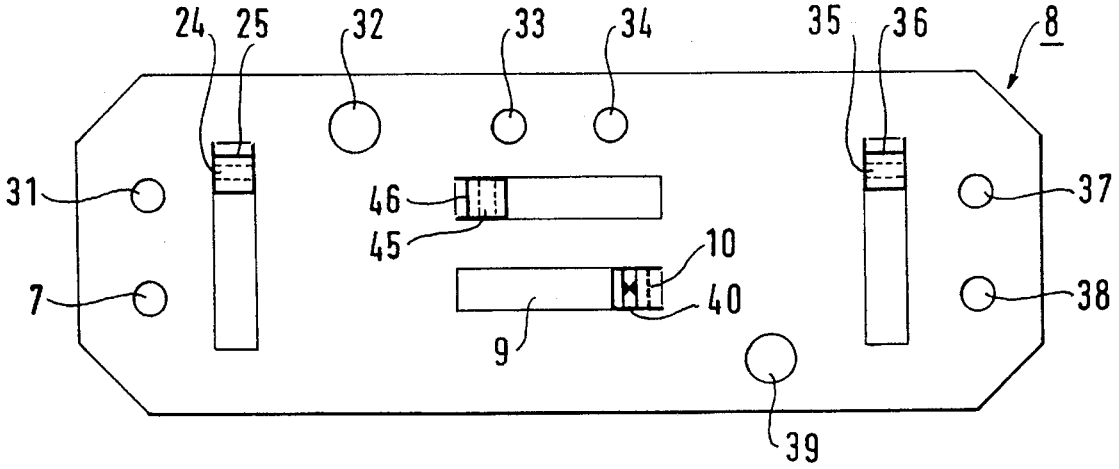
FIG. 2 is a top view of the metal plate used in this embodiment of the invention, shown on its own.
Figure 3:
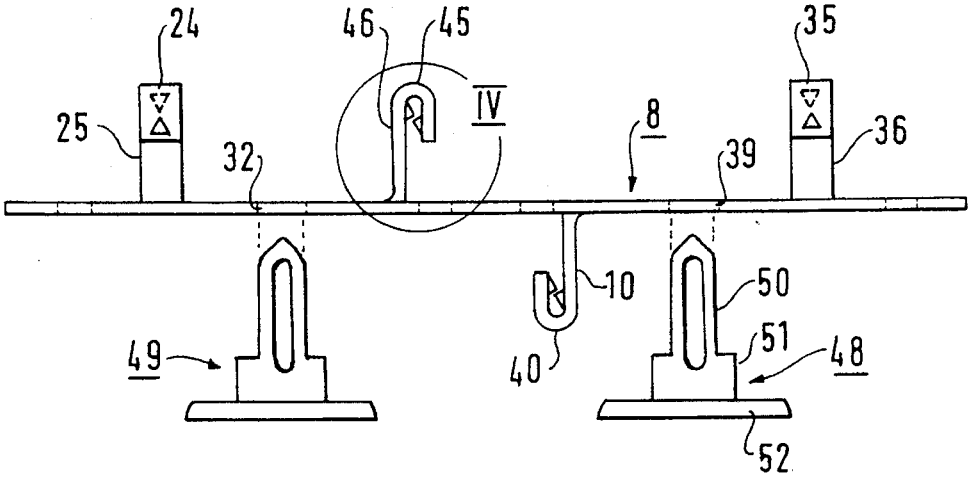
FIG. 3 is a side view of the metal plate and two insulative material spacers which support it and insulate it from the conductive enclosure forming the Faraday cage.

FIG. 2 is a top view of the metal plate 8, of which FIG. 3 is a side view. These figures show that each lug 25, 46, 10 and 36 is made by cutting out from the plate 8 a rectangular strip, bending the strip perpendicularly to the plate 8 and then bending over the end of the strip to form a respective hook 24, 45, 40, 35.

Figure 4:
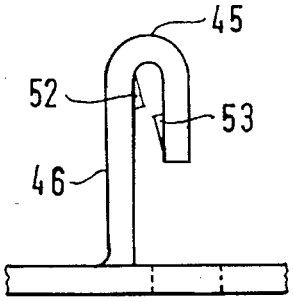
FIG. 4 shows one of the lugs cut out from this plate.

FIG. 4 shows the lug 46 from the side. The other lugs are similar. The hook 45 has two triangular stamped areas 52 and 53 facing in opposite directions on the inside of the hook 45 to constitute two raised portions to assist the crimping or soldering of a connection.

FIG. 2 shows the two holes 31 and 7 for fixing the main cable section 1, two similar holes 37 and 38 for the main cable section 18 and two similar holes 33 and 34 for the branch cable 22. The diameter of each of these holes is slightly greater than the width of the tongue of the tie and the distance between the holes of each pair is substantially equal to the diameter of the cables to be fixed.

The plate 8 also includes holes 32 and 39 approximately on a diagonal of the plate and adapted to cooperate with two plastics material spacers 48 and 49 which can be seen in the side view in FIG. 3. The spacer 48, for example, includes a flexible stud 50 having a diameter slightly larger than that of the hole 39, a shoulder 51 against which the plate 8 rests and an adhesive base 52 fixed to the bottom of the lower part 15 of the metal box. The function of these spacers is to insulate the plate 8 from the conductive box 15, 19.

When the cables have been fixed and connected, the plate 8 is fitted over the studs 50 on the spacers 48 and 49 until it rests on the shoulders 51. Friction against the studs 50 is sufficient to hold the plate 8 against the shoulder 51.

As the spacers 48 and 49 are insulators, the plate 8 is electrically insulated from the box 15, 19. The box 15, 19 is connected to a local ground terminal to protect personnel. In a network, the plate 8 of all the junction boxes except one is usually floating with respect to ground but connected to the box 15, 19 by a filter 11 passing high-frequency currents. A single junction box of the network is provided with the connection 14 for connecting the plate 8 direct to a ground terminal. The connection 14 is removed in the other boxes.

In an alternative embodiment two additional holes can be provided in the plate 8 for fixing the ground connection 14 by means of a self-locking tie so that traction on this connection is not all taken entirely by the connecting lug 41, 42.

In an alternative embodiment the metal box 15, 19 can be replaced by a plastics material box metalized on the inside to constitute a Faraday cage. The box can be in more than two pieces to facilitate its manufacture or to make it easier to fit. The cables can be fitted with grommets matched to the diameter of the holes like the holes 5 and 20, to enhance the sealing of the box.

The scope of the invention is not limited to the type of cable referred to in this example. It can be used to connect any cable including a screen and to connect any number of cables.

We claim:

1. A junction box for connecting a plurality of screened cables, each of said cables having an electromagnetic screen said box including means for fixing the cables, means for interconnecting screens of all the cables and a conductive enclosure forming a Faraday cage and including an opening for each cable;

wherein the means for fixing the cables and the means for interconnecting screens of all the cables comprise:

a metal plate incorporating:

two holes for each of the cables, the distance between said two holes for each of the cables being substantially equal to the diameter of said cables; and a lug for each of the cables, being cut out from said plate and being bent out of the plane of said plate, the lug providing a connection point for the screen of said cables; and a self-locking tie for each of said cables passing successively through the two holes corresponding to each of said cables, fitting around each of said cables and pressing each of said cables against the plate to attach each of said cables to the plate.

2. A junction box according to claim 1, wherein each of said lug for each cable has a curved end forming a hook adapted to be crimped or soldered to conductors extracted from the screen of a cable and twisted together.

3. A junction box according to claim 1, wherein, the metal plate further includes at least one additional lug cut out from said plate and bent out of the plane of said plate to constitute a connection point for a ground conductor and for a ground filter.

4. A junction box according to claim 1, wherein the enclosure forming a Faraday cage includes at least two contiguous parts said two contiguous parts having a joint line passing through all the cable openings.

* * * * *